US008784053B2

(12) United States Patent
Colson et al.

(10) Patent No.: US 8,784,053 B2
(45) Date of Patent: Jul. 22, 2014

(54) FAN SHIELD AND BEARING HOUSING FOR AIR CYCLE MACHINE

(75) Inventors: Darryl A. Colson, West Suffield, CT (US); Seth E. Rosen, Middletown, CT (US); Eric Chrabascz, Longmeadow, MA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 673 days.

(21) Appl. No.: 12/974,472

(22) Filed: Dec. 21, 2010

(65) Prior Publication Data

US 2012/0156009 A1 Jun. 21, 2012

(51) Int. Cl.
*F04D 29/44* (2006.01)

(52) U.S. Cl.
USPC ..... 415/206

(58) Field of Classification Search
USPC ..... 415/182.1, 189, 190, 206
See application file for complete search history.

(56) References Cited

U.S. PATENT DOCUMENTS

| | | | | |
|---|---|---|---|---|
| 4,580,406 | A * | 4/1986 | Nims | 62/87 |
| 5,224,842 | A | 7/1993 | Dziorny et al. | |
| 5,249,934 | A | 10/1993 | Merritt et al. | |
| 5,309,735 | A | 5/1994 | Maher, Jr. et al. | |
| 5,311,749 | A * | 5/1994 | McAuliffe et al. | 62/402 |
| RE36,101 | E | 2/1999 | Andres et al. | |
| 5,921,683 | A | 7/1999 | Merritt et al. | |
| 6,059,532 | A | 5/2000 | Chen et al. | |
| 6,151,909 | A | 11/2000 | Carter et al. | |
| 7,757,502 | B2 | 7/2010 | Merritt et al. | |
| 2006/0059942 | A1 | 3/2006 | McAuliffe et al. | |

* cited by examiner

*Primary Examiner* — Nathaniel Wiehe
*Assistant Examiner* — Adam W Brown
(74) *Attorney, Agent, or Firm* — Carlson, Gaskey & Olds, P.C.

(57) ABSTRACT

A fan shield for an air cycle machine includes a fan shield body in the general shape of a frustum of a cone having curved sides. The curved sides define a radius of curvature and a center point of curvature that corresponds to the radius of curvature. The center point of curvature is an axial distance from a large end of the fan shield body and a radial distance from the central axis such that a ratio of the radial distance to the axial distance is between 1.160 and 1.360. A bearing housing includes a body that defines a cylindrical portion and an annular flange at one end. The annular flange includes a first attachment opening, a second attachment opening and a third attachment opening that are non-uniformly circumferentially spaced around the flange.

18 Claims, 4 Drawing Sheets

FAN SHIELD AND BEARING HOUSING FOR AIR CYCLE MACHINE

BACKGROUND

This disclosure relates to a fan shield and bearing housing that are incorporated into an air cycle machine.

An air cycle machine may include a centrifugal compressor and a centrifugal turbine mounted for co-rotation on a shaft. The centrifugal compressor further compresses partially compressed air, such as bleed air received from a compressor of a gas turbine engine. The compressed air discharges to a downstream heat exchanger or other use before returning to the centrifugal turbine. The compressed air expands in the turbine to thereby drive the compressor. The air output from the turbine may be utilized as an air supply for a vehicle, such as the cabin of an aircraft.

SUMMARY

A fan shield for an air cycle machine includes a fan shield body in the general shape of a frustum of a cone having curved sides. The curved sides define a radius of curvature and a center point of curvature that corresponds to the radius of curvature. The center point of curvature is an axial distance from a large end of the fan shield body and a radial distance from the central axis such that a ratio of the radial distance to the axial distance is between 1.160 and 1.360.

A bearing housing includes a body that defines a cylindrical portion and an annular flange at one end. The annular flange includes a first attachment opening, a second attachment opening and a third attachment opening that are non-uniformly circumferentially spaced around the flange.

In another aspect, an air cycle machine includes a main shaft having a compressor rotor and a turbine rotor mounted for rotation thereon. A fan motor is mounted on the main shaft and operable to produce an air flow. The fan shield body is mounted near the fan rotor to define a flow path for the airflow from the fan rotor. The fan shield body is secured to the bearing housing body.

An exemplary method of installing the fan shield and the bearing housing on the air cycle machine includes securing the annular flange of the bearing housing body between the fan shield body and a structure of the air cycle machine such that, together, the fan shield body and the bearing housing body establish a fan air flow path.

BRIEF DESCRIPTION OF THE DRAWINGS

The various features and advantages of the disclosed examples will become apparent to those skilled in the art from the following detailed description. The drawings that accompany the detailed description can be briefly described as follows.

DETAILED DESCRIPTION OF THE PREFERRED EMBODIMENT

Figure 1:
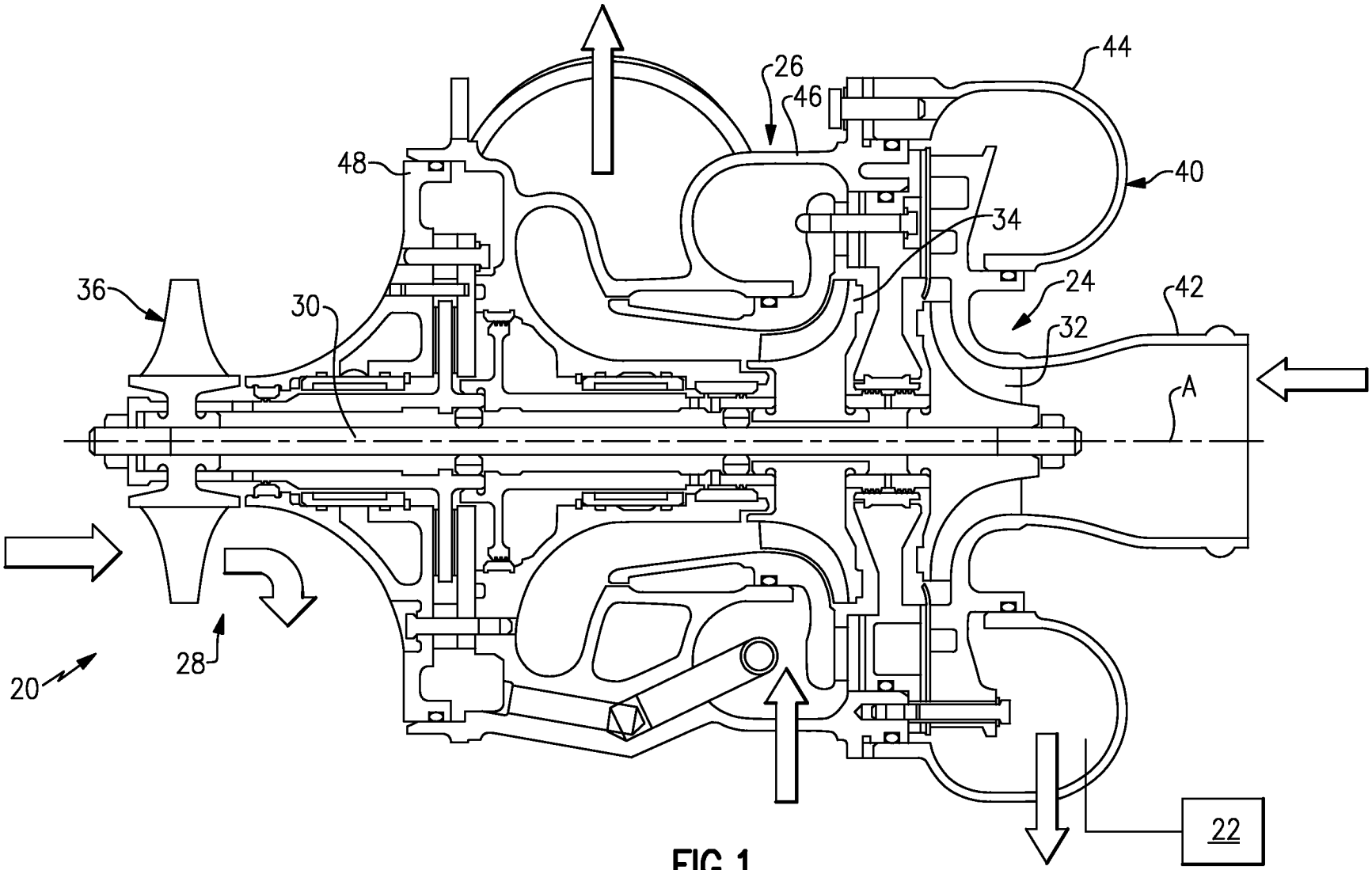
FIG. 1 illustrates an example air cycle machine.

FIG. 1 shows an example air cycle machine 20 ("ACM") that is incorporated into an air supply system 22 of a vehicle, such as an aircraft, helicopter, or land-based vehicle. The ACM 20 includes a compressor section 24, a turbine section 26 and a fan section 28 that are generally disposed about a main shaft 30, such as a tie rod. The compressor section 24 includes a compressor rotor 32, the turbine section 26 includes a turbine rotor 34, and the fan section 28 includes a fan rotor 36. The compressor rotor 32, turbine rotor 34, and fan rotor 36 are secured on the main shaft 30 for co-rotation about an axis A. The ACM 20 is generally constructed from a housing 40 having inlet, compressor, turbine and bearing housing portions 42, 44, 46 and 48.

Figure 2:
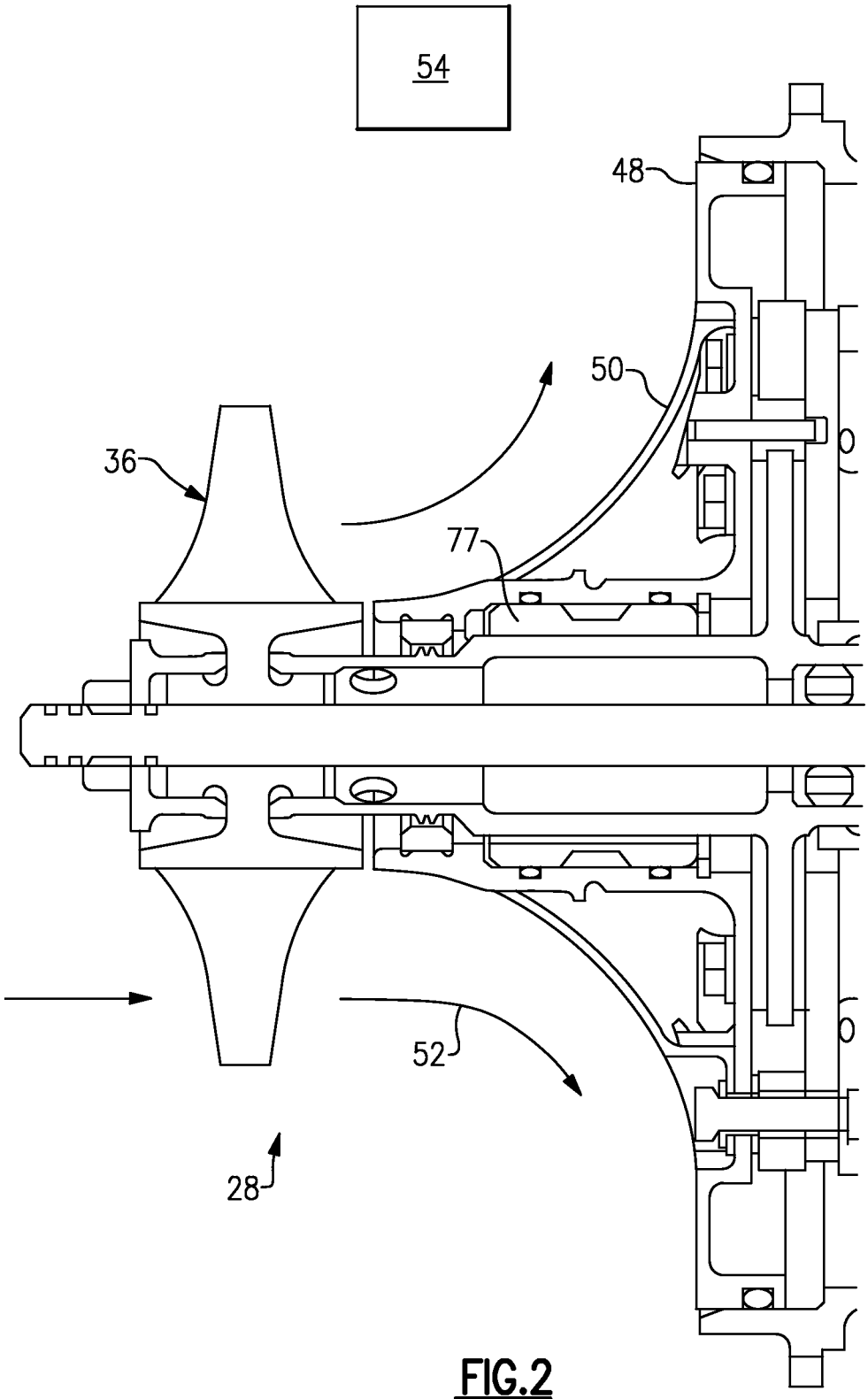
FIG. 2 illustrates a portion of the air cycle machine of FIG. 1.

Referring to FIG. 2 depicting the fan section 28 of the ACM 20, a fan shield 50 is mounted on the bearing housing 48 such that, together, the bearing housing 48 and the fan shield 50 define an air flow path 52 for air flow from the fan rotor 36. For instance, surfaces of the bearing housing 48 and the fan shield 50 deflect air flow from the fan rotor 36. The air flow path 52 directs the air flow in a particular direction to be received by a heat exchanger 54. The direction at which the bearing housing 48 and the fan shield 50 divert the air flow from the fan rotor 36 influences the efficiency of operation of the heat exchanger 54. In this regard, the shape and position of the bearing housing 48 and the fan shield 50 provide a proper diversion of the air flow to the heat exchanger 54.

Figure 3:
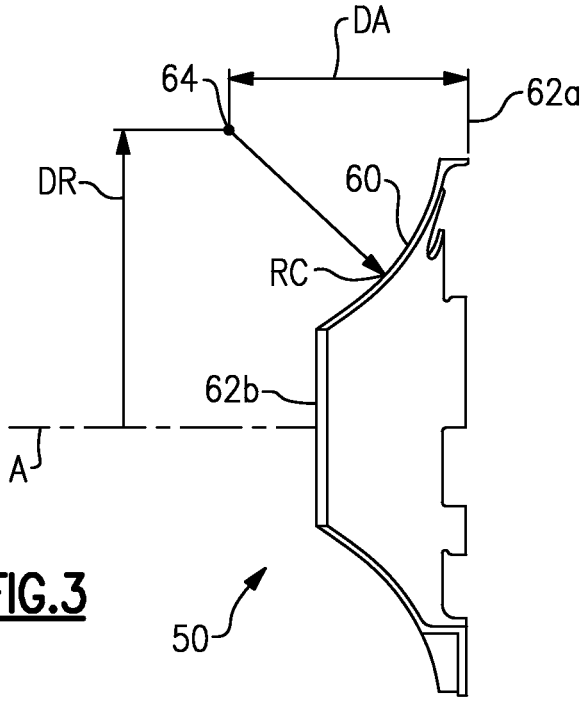
FIG. 3 illustrates an example fan shield.
Figure 4:
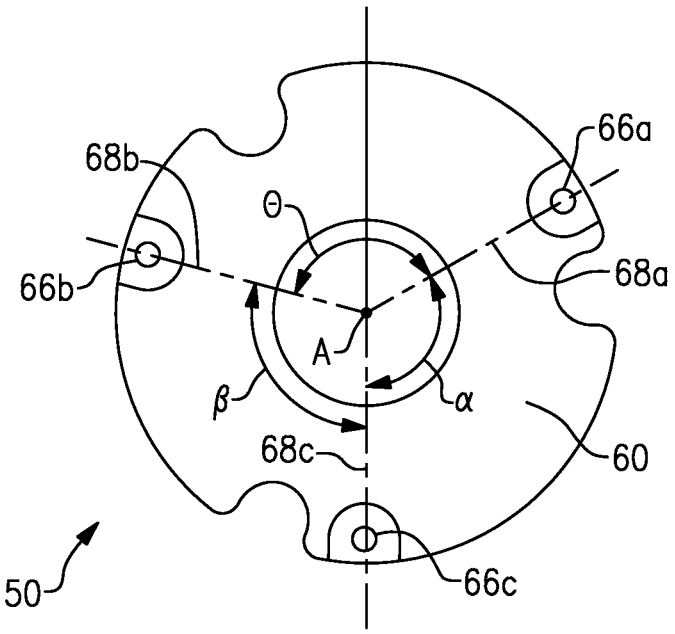
FIG. 4 illustrates an axial view of an example fan shield.

FIG. 3 shows a cross-sectional view of the fan shield 50 and FIG. 4 shows an axial view of the fan shield 50. In the illustrated embodiment, the fan shield 50 is in the general shape of a frustum of a cone having curved sides 60 that extend around the central axis A. In general, a frustum is the portion of a shape that lies between two parallel planes. In this case, the planes are planes 62*a* and 62*b* that correspond to the respective large end face and small end face of the fan shield 50.

The curved sides 60 of the body of the fan shield 50 define a radius of curvature, RC, and a center point 64 that corresponds to the radius of curvature. The center point 64 is a point in space that lies on a normal vector from the curved side 60 and is located a distance from the curved side 60 that is equal to the radius of curvature. The center point 64 is designed to be located at a specific position relative to the central axis A and plane 62*a* of the fan shield 50 to achieve a proper diversion of air flow from the fan rotor 36.

As an example, the fan shield 50 defines an axial distance DA from the plane 62*a* to the center point 64, and a radial distance DR from the central axis A to the center point 64. In embodiments, a ratio DR/DA is between 1.160 and 1.360 to ensure a proper position of the curved sides 60 for diverting the air flow. In further embodiments, the ratio DR/DA is between 1.210 and 1.310. In another embodiment, the ratio DR/DA is 1.260.

Additionally, the ratios of the distances DR and DA to the radius of curvature RC may be designed to properly orient the curved sides 60 for diverting the air flow. In embodiments, a ratio DR/RC is between 1.3 and 1.5. In a further embodiment, the ratio DR/RC is 1.4. A ratio DA/RC may be between 1.011 and 1.211. In a further embodiment, the ratio DA/RC may be 1.111.

The body of the fan shield 50 also defines a first attachment opening 66*a*, a second attachment opening 66*b* and a third attachment opening 66*c* that are non-uniformly circumferentially spaced around the fan shield 50. The attachment openings 66*a-c* are aligned along respective angular positions 68*a*, 68*b* and 68*c* around the circumference of the fan shield 50. Thus, between any two of the angular positions 68*a*, 68*b* and 68*c* there is a corresponding angle. For instance, the angular positions 68*a* and 68*c* define an angle alpha therebetween, the angular positions 68*c* and 68*b* define an angle beta therebetween and the angular positions 68*a* and 68*b* define an angle theta therebetween.

In embodiments, the angle alpha is non-equivalent to the angle beta and the angle theta, and the angle beta is non-equivalent to the angle theta. In a further embodiment, the angular positions 68*a*, 68*b* and 68*c* define the angles such that there is a ratio alpha:beta:theta that is 21:24:27. The positioning of the attachment openings 66*a*, 66*b* and 66*c* around the circumference of the fan shield 50 facilitates a proper installation of the fan shield 50 with regard to the bearing housing 48, as will be discussed in further detail below.

Figure 5:
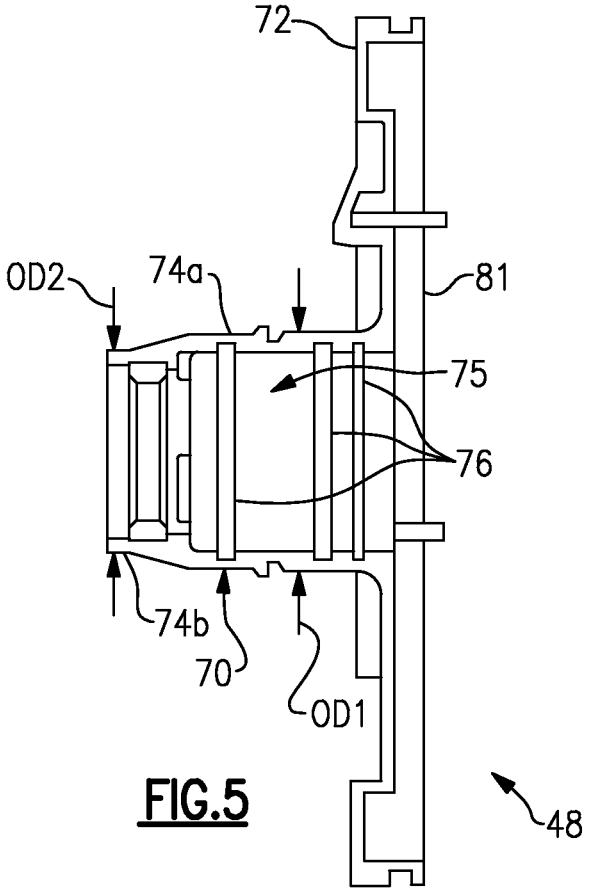
FIG. 5 illustrates a cross-sectional view of a bearing housing.

FIG. 5 depicts a cross-sectional view of the bearing housing 48. As shown, the bearing housing 48 generally includes a cylindrical portion 70 and an annular flange 72 that is located at one end of the cylindrical portion 70. The cylindrical portion 70 includes a first portion 74*a* that defines a corresponding outer diameter OD1 and a second portion 74*b* that defines a second outer diameter OD2 that is less than the first outer diameter OD1. The cylindrical portion 70 also includes a bore 75 that defines a plurality of circumferential grooves 76 therein. As an example, the circumferential grooves 76 facilitate a proper positioning of a journal bearing 77 (see FIG. 2) within the cylindrical portion 70.

Figure 6:
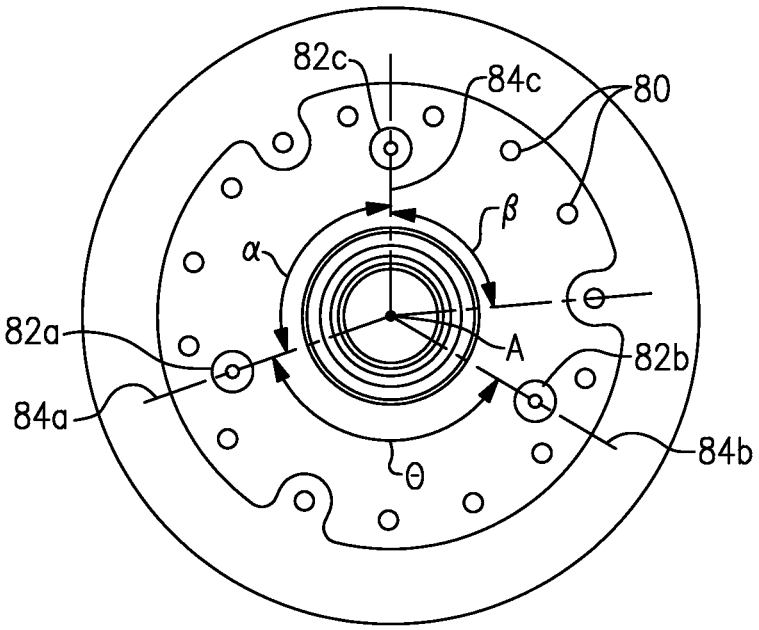
FIG. 6 illustrates an axial view of an example bearing housing.

In the arrangement of the ACM 20, the annular flange 72 of the bearing housing 48 is located between the fan shield 50 and another structure of the ACM 20, such as the turbine housing 46. In that regard, as shown in the axial view of FIG. 6, the bearing housing 48 includes a plurality of attachment openings 80 for securing the bearing housing 48 to the other structure of the ACM 20. Collectively, the openings 80 of the bearing housing 48 are located circumferentially around the annular flange 72. In the illustrated embodiment, each of the openings 80 is located an equivalent radial distance from the axis A. The bearing housing 48 also defines a thrust bearing surface 81 on a side opposite from the cylindrical portion 70.

The annular flange 72 also includes attachment openings 82*a*, 82*b* and 82*c* that axially align with the respective attachment openings 66*a*, 66*b* and 66*c* of the fan shield 50. In that regard, the attachment openings 82*a*, 82*b* and 82*c* are equivalently located at angular positions 84*a*, 84*b* and 84*c*, with corresponding angles alpha, beta, and theta between pairs of the angular positions 84*a*, 84*b* and 84*c*, similar to as described above for the angular positions 68*a*, 68*b* and 68*c*. Thus, to install the fan shield 50 on the ACM 20, the attachment openings 66*a*, 66*b* and 66*c* are axially aligned with the corresponding attachment openings 82*a*, 82*b* and 82*c* to receive a fastener therethrough to secure the fan shield 50 on the ACM 20. The annular flange 72 of the bearing housing 48 is thereby sandwiched between the fan shield 50 and the other structure of the ACM 20.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A fan shield for an air cycle machine, the fan shield comprising:

a fan shield body in the general shape of a frustum of a cone having curved sides that extend around a central axis, the curved sides define a radius of curvature (RC) and a center point of curvature that corresponds to the radius of curvature, the center point of curvature is an axial distance (DA) from a large end of the fan shield body and radial distance (DR) from the central axis such that a ratio DR/DA is between 1.160 and 1.360, wherein the fan shield body includes a first attachment opening, a second attachment opening and a third attachment opening that are non-uniformly circumferentially spaced around the fan shield body.

2. The fan shield as recited in claim 1, wherein the ratio DR/DA is between 1.210 and 1.310.

3. The fan shield as recited in claim 1, wherein the ratio DR/DA is 1.260.

4. The fan shield as recited in claim 1, wherein a ratio DR/RC is between 1.3 and 1.5.

5. The fan shield as recited in claim 4, wherein the ratio DR/RC is 1.4.

6. The fan shield as recited in claim 1, wherein a ratio DA/RC is between 1.011 and 1.211.

7. The fan shield as recited in claim 6, wherein the ratio DA/RC is 1.111.

8. The fan shield as recited in claim 1, wherein each of the first attachment opening, the second attachment opening and the third attachment opening are located at respective angular positions that define angles, alpha, beta and theta between respective pairs of the angular positions, and a ratio of alpha: beta:theta is 21:24:27.

9. A bearing housing for an air cycle machine, the bearing housing comprising:

a bearing housing body that defines a cylindrical portion that extends around a central axis and an annular flange at one end of the cylindrical portion, the annular flange includes a first attachment opening, a second attachment opening and a third attachment opening for attaching a fan shield body thereto, and the attachment openings are non-uniformly circumferentially spaced around the annular flange.

10. The bearing housing as recited in claim 9, wherein the first attachment opening, the second attachment opening and the third attachment opening are located at respective angular positions that define angles, alpha, beta and theta between respective pairs of the angular positions, and a ratio of alpha: beta:theta is 21:24:27.

11. The bearing housing as recited in claim 9, wherein the cylindrical portion includes a first portion defining a first outside diameter and a second portion defining a second outside diameter that is less than the first outside diameter.

12. The bearing housing as recited in claim 9, wherein the annular flange includes a thrust bearing surface on a side opposite from the cylindrical portion.

13. The bearing housing as recited in claim 9, wherein the cylindrical portion defines a bore that includes a plurality of circumferential grooves therein.

14. The bearing housing as recited in claim 9, wherein the annular flange includes additional circumferentially-spaced openings that are located radially outwards of the first attachment opening, the second attachment opening and the third attachment opening.

15. An air cycle machine comprising:

a main shaft having a compressor rotor and a turbine rotor mounted for rotation thereon;

a fan rotor mounted on the main shaft and operable to produce an air flow;

a fan shield body mounted near the fan rotor, the fan shield body is in the general shape of a frustum of a cone having curved sides and extends around a central axis, the curved sides define a flow path for the air flow from the fan rotor, the curved sides further define a radius of curvature and a center point of curvature that corresponds to the radius of curvature, the center point of curvature is an axial distance DA from a large end of the fan shield body and a radial distance DR from the central axis such that a ratio DR/DA is between 1.160 and 1.360; and a bearing housing body that defines a cylindrical portion that extends around the central axis and an annular flange at one end of the cylindrical portion, the annular flange includes a first attachment opening, a second attachment opening and a third attachment opening by which the fan shield body is secured to the bearing housing body, and the attachment openings are non-uniformly circumferentially spaced around the annular flange.

16. The air cycle machine as recited in claim 15, wherein the ratio DR/DA is between 1.210 and 1.310, and the first attachment opening, the second attachment opening and the third attachment opening are located at respective angular positions around the annular flange to define angles, alpha, beta and theta between respective pairs of the angular positions, and a ratio of alpha:beta:theta is 21:24:27.

17. The air cycle machine as recited in claim 16, wherein the ratio DR/DA is 1.260.

18. A method of installing a fan shield and a bearing housing on an air cycle machine, the method comprising:

securing an annular flange of a bearing housing body between a fan shield body and a structure of an air cycle machine such that, together, the fan shield body and the bearing housing body establish a fan air flow path, the fan shield body is in the general shape of a frustum of a cone having curved sides that extend around a central axis, the curved sides define a radius of curvature and a center point of curvature that corresponds to the radius of curvature, the center point of curvature is an axial distance DA from a large end of the fan shield body and a radial distance DR from the central axis such that a ratio DR/DA is between 1.160 and 1.360, and the bearing housing body defines a cylindrical portion that extends around a central axis and the annular flange at one end of the cylindrical portion, the annular flange includes a first attachment opening, a second attachment opening and a third attachment opening for attaching the fan shield body thereto, and the attachment openings are non-uniformly circumferentially spaced around the annular flange.

* * * * *